US005957601A

United States Patent [19]

Weiss

[11] Patent Number: 5,957,601

[45] Date of Patent: Sep. 28, 1999

[54] MULTI-SEGMENT WRITING IMPLEMENT

[76] Inventor: Marla Weiss, 64-39 98th St., Rego Park, N.Y. 11374

[21] Appl. No.: 09/027,646

[22] Filed: Feb. 23, 1998

[51] Int. Cl.[6] ..... B43K 27/02

[52] U.S. Cl. ..... 401/18; 401/57

[58] Field of Search ..... 401/18, 34, 57, 401/52, 195

[56] References Cited

U.S. PATENT DOCUMENTS

| | | | |
|---|---|---|---|
| 3,790,291 | 2/1974 | Hung et al. | 401/57 |
| 3,898,009 | 8/1975 | Christensen | 401/57 |
| 4,610,556 | 9/1986 | Tsai | 401/18 |
| 5,044,804 | 9/1991 | Chuang | 401/57 |
| 5,791,798 | 8/1998 | Yu | 401/18 |

*Primary Examiner*—David J. Walczak

*Attorney, Agent, or Firm*—Schweitzer Cornman Gross & Bondell LLP

[57] ABSTRACT

A multi-segment writing implement has a plurality of a cylindrical, nested-stackable writing implement segments with different writing elements attached thereto and which connect in various combinations to form a writing implement with various writing elements on the ends thereof. A first type of writing implement segment has a writing implement and connector on one end and an opening and attachment collar on the opposite end. The opening communicates with a hollow cavity to allow nested stacking of the segments. A second type of segment has a connector on both ends and a writing element on one end. The attachment collars and connectors of the segments are configured for releasable, frictional nested connection of adjacent segments. Either end of the segment of the second type can be connected to the attachment collar of a first type of connector, thus providing a large number of possible configurations of the multi-segment writing implement.

5 Claims, 3 Drawing Sheets

FIG. 2
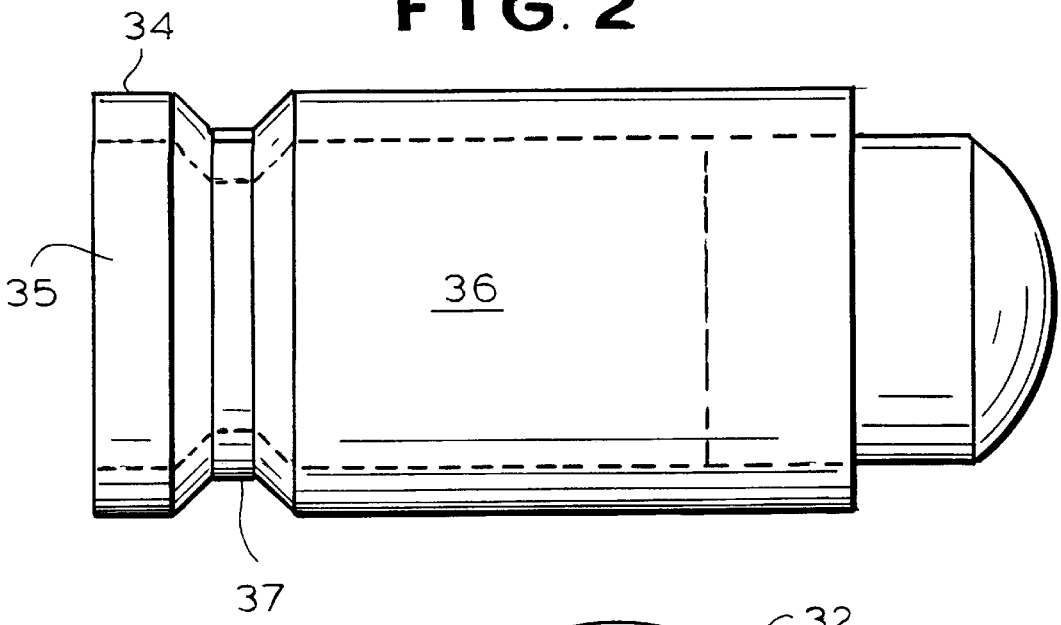
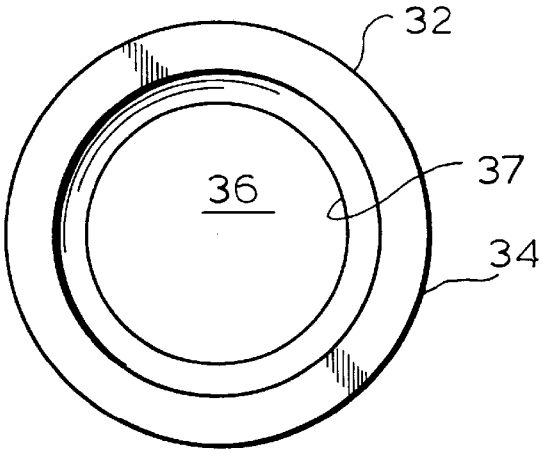
FIG. 3
FIG. 4
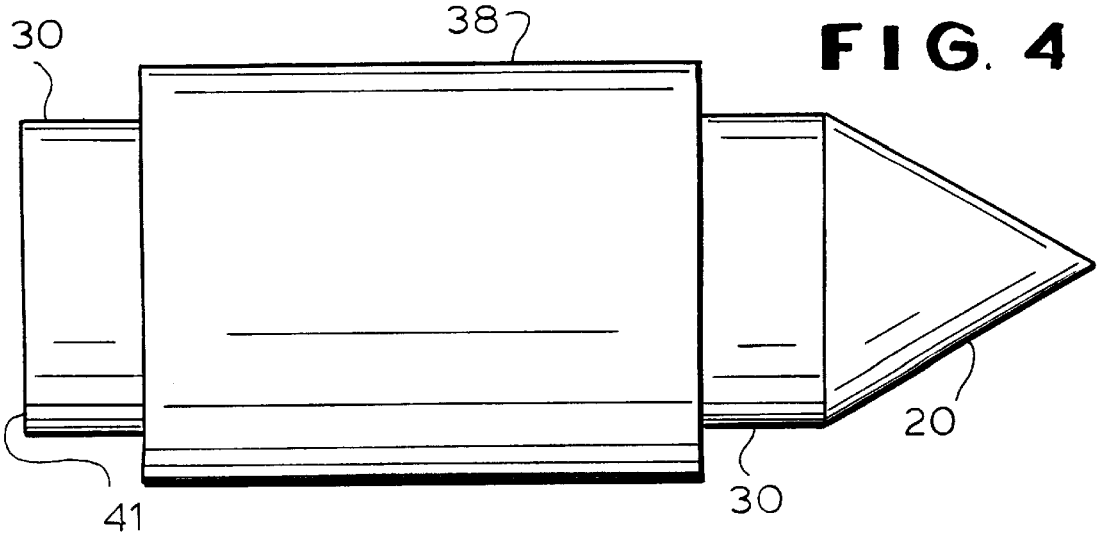

MULTI-SEGMENT WRITING IMPLEMENT

FIELD OF THE INVENTION

This invention pertains to writing implements and, in particular, to multi-segment writing implements with interchangeable writing elements.

BACKGROUND AND SUMMARY OF THE INVENTION

Multi-segment writing implements with interchangeable writing elements are known. However, none offer various types of segments which can be easily assembled in various combinations, as does the present invention.

The present invention comprises a number of interchangeable, preferably cylindrical segments, each having at least one closed end. Extending from the closed end is a writing element such as a pencil, pen, eraser, highlighter or other similar writing, marking or erasing element. A plurality of segments also have an open end and a hollow cavity to allow nested stacking of the segments to form an elongated, multi-segment writing implement.

The open-ended segments also have a preferably cylindrical collar located at the open end thereof which is sized to mate with the also preferably cylindrical closed end of an adjacent segment (over the writing element thereof) when the segments are stacked in a nested relation. Thus, the collar forms a female connector which mates with a male closed end of an adjacent segment.

Preferably, one segment has an end opposite the writing element thereof which is sized to mate within a collar of one of the other segments. Thus, this segment has two male connectors on each end.

As will be further described below, the configuration of the segments allows the writing implement to be reassembled in any one of a number of configurations to create a writing implement with the desired combination of writing elements on opposite ends.

BRIEF DESCRIPTION OF THE DRAWINGS

For a complete understanding of the above and other features of the invention, reference shall be made to the following detailed description of the preferred embodiments of the invention and to the accompanying drawings, wherein:

FIGS. 2 and 3 are a side and rear elevational view, respectively, of a first type of writing implement segment;

FIG. 4 is a side elevational view of a second type of writing implement segment;

DETAILED DESCRIPTION OF THE INVENTION

Figure 1:
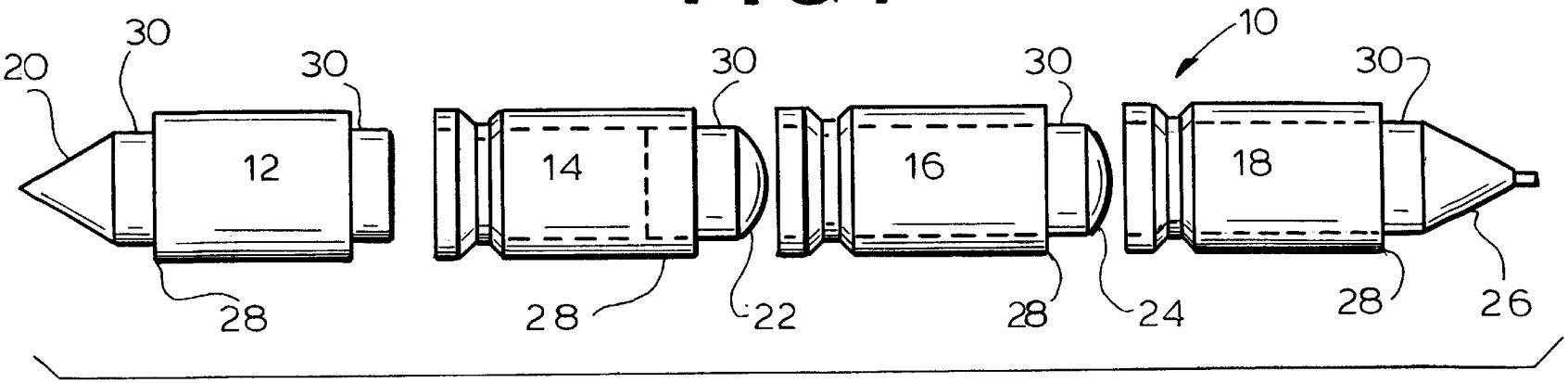
FIG. 1 is an exploded, side elevational view of the writing implement of the present invention.

Referring to FIG. 1, the multi-segment writing implement 10 of the present invention includes a number of preferably cylindrical segments 12, 14, 16, 18, each of which can include one of, for example a pen 20, highlighter 22, eraser 24, or pencil 26, or the like, referred to herein collectively as writing elements. The writing elements 20, 22, 24, 26 are located on a closed end 28 of the segments. The closed ends

28 have a preferably cylindrical male connector portion 30 located inwardly of the writing elements 20, 22, 24, 26. As can be appreciated, the segments 12, 14, 16, 18 can be joined in various combinations to form the composite writing implement 10.

Figure 5:
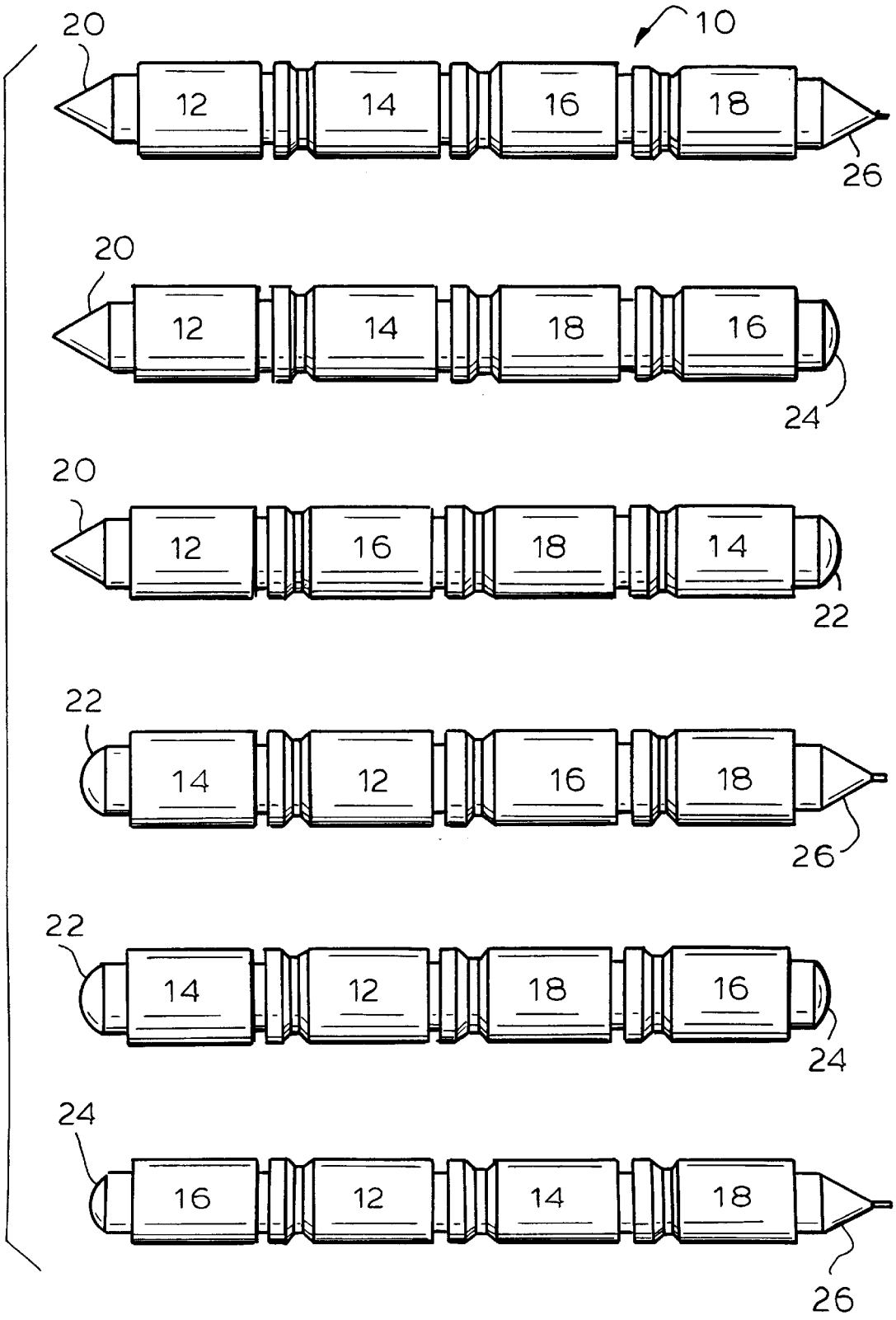
FIG. 5 is a view of an assortment of combinations of writing implement segments.

Referring to FIGS. 2 and 3, the writing implement includes a plurality of a first type of segment 32, the segments 14, 16, and 18 of FIG. 1 being of this first type. The first type of segment 32 has an open end 35 and a hollow cavity 36 adapted to receive a writing element of an adjacent segment when the segments are stacked in a nested relation (as shown in FIG. 5). The segment 32 also includes a preferably cylindrical female collar 34 adapted to mate with and over the male connector portion 30 of an adjacent segment. The male connector segment 30 and female collar 34 can be sized and shaped for a tight, but releasable, frictional or snap-fit, in which case, the connector portion 30 can be somewhat longer than the female collar 34 and the segment 32 can include an inward projection such as a reduced neck portion 37, which extends into the hollow cavity 36 to limit the inward movement of the male connector portion 30.

Figure 6:
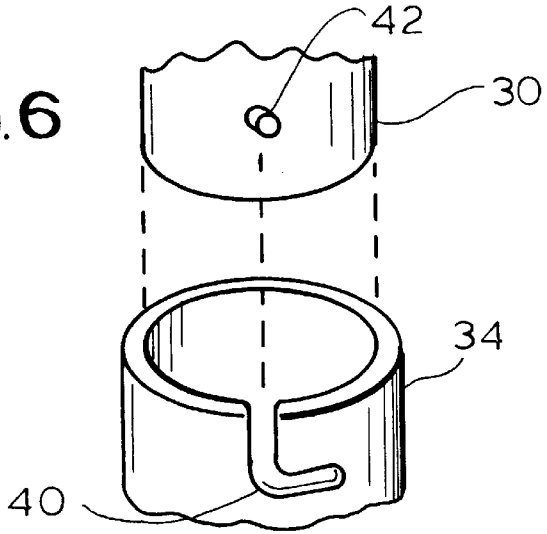
FIG. 6 is an exploded perspective view of the two segments of the invention.

Referring to FIG. 6, alternatively, the female collar 34 can include a right-angled slot 40 which receives a projection extending outwardly from the male connector segment 30. Thus, to join adjacent segments, the projector 42 would be aligned with the opening of the slot 40, the two segments would be urged together and then rotated with respect to one another such that the projection locks in the lateral section of the slot to secure the segments together.

Referring to FIG. 4, the writing implement 10 also includes a second type of segment 38, the segment 12 of FIG. 1 being of this second type. The second type of segment 38 has an end 41 opposite the writing element 20 thereof which is sized and shaped preferably identical to that of the male connector element 30 adjacent the writing element 20 and to that of the male connector elements 30 of the first type of segments 32.

Thus, it can be appreciated that, the second type of segment 38 can be joined to a female collar 34 of a first type of segment 32 in either direction or on both ends, thereby increasing the possible arrangements of the segments 12, 14, 16, 18. Also, the segments can include ink reservoirs (not shown) inside the hollow cavities thereof.

Referring to FIG. 5, the multi-segment writing implement 10 can be assembled in a number of configurations with the possibility of a writing element extending from one or both ends. As can be seen from the examples shown in FIG. 5, going from top to bottom, the writing implement 10 can be assembled with the following combinations of writing elements on the ends: pen 20 and pencil 26; pen 20 and eraser 24; pen 20 and highlighter 22; highlighter 22 and pencil 26, highlighter 22 and eraser 24; and eraser 24 and pencil 26. In addition, if the second type of segment 38 is on one of the ends of the writing implement 10, the second type of segment 38 can be oriented inwardly (not shown) such that only one writing element extends from the writing implement.

Thus, the writing implement of the present invention provides a large number of possible combinations for writing elements in a writing implement in an inexpensive and easily changeable manner.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A multi-segment writing implement, comprising:

a plurality of a first type of writing implement segment and at least one of a second type;

said first type of writing implement segment having a body portion with a first end and a second end, and a hollow cavity in communication with said second end, and having a writing element extending from said first end;

said first type of writing implement segment having attachment collar means located adjacent said second end thereof, and having connector means located adjacent said first end thereof;

said second type of writing implement segment having a body with a first end, a second end, and connector means located adjacent both said first and second ends, and having a writing element extending from said first end;

said hollow cavity of said first type of segment being sized and shaped to accept a writing element of an adjacent writing implement segment of said first or second type when said segments are stacked in nested relation;

said attachment collar means of said first type of segment being sized and shaped to releasably engage said connector means of said adjacent segment of said first or second type to mate said adjacent segments to form a length of said writing implement, either end of said second type of segment being connectible to said attachment collar of said first type of connector;

whereby, said writing implement can be assembled in various forms by connecting a plurality of writing implement segments of said first type in combination with a segment of said second type, each with one of a variety of types of writing elements.

2. A multi-segment writing implement as in claim 1, wherein said connector means of said segments of said first and second type are longer than said attachment collar of said segment of said first type.

3. A multi-segment writing implement as in claim 1, wherein said body of said first type of segment further comprises a portion projecting inwardly into said hollow cavity, said inwardly-projecting portion being adjacent, but spaced from, said second end thereof and being adapted to limit the inward movement of a connector of a segment of said first or second type.

4. A multi-segment writing implement as in claim 1, wherein said bodies of said first and second type of segments and said connectors are cylindrical in shape, and said attachment collars are circular in shape.

5. A multi-segment writing implement as in claim 1, wherein said attachment collar means of said first type of segment is sized and shaped to releasably engage said connector means of said adjacent segment of said first or secondtype, by frictional or snap-fit connection.

* * * * *